US005737864A

United States Patent [19]

Otto

[11] Patent Number: 5,737,864

[45] Date of Patent: Apr. 14, 1998

[54] SAFETY-DEVICE FOR LOCKING FIRE-ARMS

[76] Inventor: Milton Otto, Rua Serra dos Parecis, 155 - Diadema - SP, Brazil

[21] Appl. No.: 780,187

[22] Filed: Dec. 26, 1996

[30] Foreign Application Priority Data

Dec. 28, 1995 [BR] Brazil ..... 9505479

[51] Int. Cl.[6] ..... F41A 17/00

[52] U.S. Cl. ..... 42/70.11

[58] Field of Search ..... 42/70.11

[56] References Cited

U.S. PATENT DOCUMENTS

| | | | |
|---|---|---|---|
| 3,018,576 | 1/1962 | Riechers | 42/1 |
| 3,022,598 | 2/1962 | Wikstrom | 42/66 |
| 3,605,311 | 9/1971 | Hermann | 42/1 N |
| 3,634,963 | 1/1972 | Hermann | 42/1 N |
| 4,048,741 | 9/1977 | Chiodo et al. | 42/1 LP |
| 4,092,794 | 6/1978 | Moren | 42/1 LP |
| 4,802,298 | 2/1989 | Baugus | 42/70.11 |
| 4,835,894 | 6/1989 | Libassi | 42/70.11 |
| 5,419,069 | 5/1995 | Mumbleau et al. | 42/70.11 |
| 5,465,519 | 11/1995 | Blanck | 42/70.11 |

*Primary Examiner*—Charles T. Jordan
*Assistant Examiner*—Meena Chelliah
*Attorney, Agent, or Firm*—Greenblum & Bernstein P.L.C.

[57] ABSTRACT

A safety device for locking fire-arms prevents the use of a revolver by an unauthorized person. A main body of tubular configuration includes a key-core, which can be axially displaced and is arranged inside the main body. A locking element projects from a piece which contacts a spring. The spring contacts a bottom wall of the main body. An end of the locking device passes through a window in the bottom wall.

17 Claims, 3 Drawing Sheets

SAFETY-DEVICE FOR LOCKING FIRE-ARMS

This invention relates to a safety device especially developed to lock fire-arms, thus avoiding its use by unauthorized persons. The aforesaid device is especially for the use of revolver-type fire-arms, no matter their caliber.

Everybody is aware that all aspects related to the use of fire-arms as a whole must be treated with the utmost care by keeping a maximum safety rate.

The numberless hazards due to the misuse of such fire-arms as pistols, revolvers and other handguns causing fatal accidents whose victims are almost always children.

Among the several factors related to the use of fire-arms, the one which deserves special attention is how the aforesaid fire-arm is kept, mainly at home.

Whenever a fire-arm is likely to be shot by a child, the usual precaution is almost always to hide the weapon, put it out of the child's reach. Such a weapon is almost always unloaded.

Such a practise, despite being quite simple, has not been very successful in avoiding accidents, because the children's natural curiosity will succeed, sooner or later, in finding both the fire-arm and its bullets, even if they are kept separately.

In this context, revolvers are especially more dangerous owing to the fact that their functioning principle besides being quite easy and obvious is well known to children who have at least a faintest idea of how such a weapon must be loaded, which is the first step for a fatal accident.

On the other hand, from the point of view of the correct use of fire-arms as an instrument to protect the home or whatever other premises or property to be defended, it is not interesting that the fire-arm and its respective bullets be kept separately, once, in an emergency situation, a precious time will be lost in order to take the fire-arm and afterwards the bullets, and another period time will be also lost in order to load the fire-arm, such an act will be made all the more difficult due to the natural tension the user feels bearing in mind the very circumstance when the firm-arm is to be used.

As an attempt to reduce the risks of accidents with revolver-type fire-arms several devices have been developed. We can state two examples: the first one made up of a piece which uses a padlock device to enable the fastening of a component which encompassed the whole of the trigger guard, thus hindering the access to the trigger of the gun; the other one is more sophisticated. It is based on the principle to prevent the access to the trigger and consists of a large cube-shaped component, locked by a simple key and which foresees the use of a sound alarm with a delayer which is operated when the fire-arm is being moved and which rings a few seconds afterwards.

The first type, despite being very simple and being characterized by quite an easy handling, does not prevent, for instance, the actuation of the hammer of the gun, which can be moved in the rear, provoking at the same time the rotation of the drum, thus, when released, the hammer could cause the shot of the bullet lodged in the chamber which is aligned with the gun barrel. This happens, even when the device is connected to the trigger guard of the gun.

The same device does not prevent either that the hammer of the gun be moved or opened, a fact that enable the easy access to the bullets which are inside and thus it is also a risky situation.

The second type, much more sophisticated, embodies a sound alarm, and besides the same drawbacks as the more simple modality, is quite inadequate bearing in mind the bulk of the device, which makes more difficult to keep the fire-arm itself; moreover the aforesaid soung alarm could present a risky situation when, during an emergency, the fire-arm is to be effectively used, once if the time for opening the device is over, such an operation has not been carried out, the alarm will unfailingly ring, and can even denounce the attempt of the action and the location of the user; moreover, if the warning of the manufacturer of the weapon has been taken into account, the aforesaid firearm has been kept unloaded, delaying even more any defense action.

One of the objectives of this Patent of Invention relates to supply a safety device for locking revolver-type fire-arms, which acts in a totally satisfactory way by preventing the actioning of a revolver by an unauthorized person, also preventing the functioning cycle thereof.

Another objective of this patent of invention relates to a safety device which uses a totally new principle of actuation which is not based on the locking of the access to the gun trigger.

It is still another objective of this patent of invention to supply a safety device which is characterized by a simple embodiment and whose manufacture is easy and cheap.

Finally, one of the objectives of this patent of invention is to provide a safety device, especially aimed at using revolver-type firearms, which actuates according to the principle of preventing man the rotation and the openness or displacement of the gun drum, a fact that, bearing in mind the very functioning cycle of revolvers, makes impossible the firing of the fire-arm itself as well as the withdrawal of the bullets from the drum and also the action of its hammer.

Because of the drawbacks already listed, and bearing in mind the above-referred objectives, this safety device for locking fire-arms has been developed and will be described in-depth as far as the drawings below are concerned:

Figure 1:
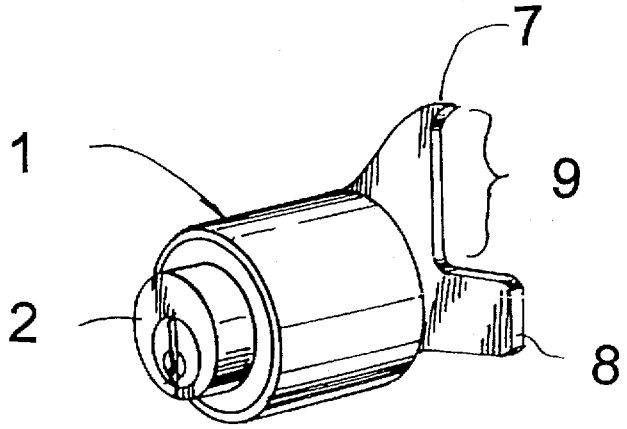
FIG. 1 shows a perspective view of the aforesaid device.
Figure 2:
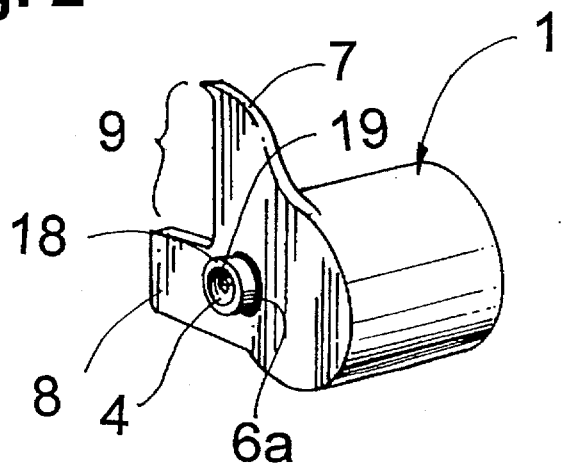
FIG. 2 shows a perspective view from the opposite side of the one shown in FIG. 1.

As per the above-referred figures, this safety device is characterized by consiting of a main body 1, tubular configuration, in whose inside there is a key-core 2, which can be axially moved, the aforesaid key-core 2, regardless of its inner construction which does not belong to the scope of protection of this patent of invention, is arranged inside the main body 1, in a way to operate a piece 3, from which a locking element 4 is projected. Such an element 4 can have the shape of a pin or a small flap, for an illustrative purpose the pin will be shown. The aforesaid piece 3 is leaned against a spring 5, and this spring 5 is also leaned against the bottom wall 6 of the aforesaid main body 1.

Figure 3:
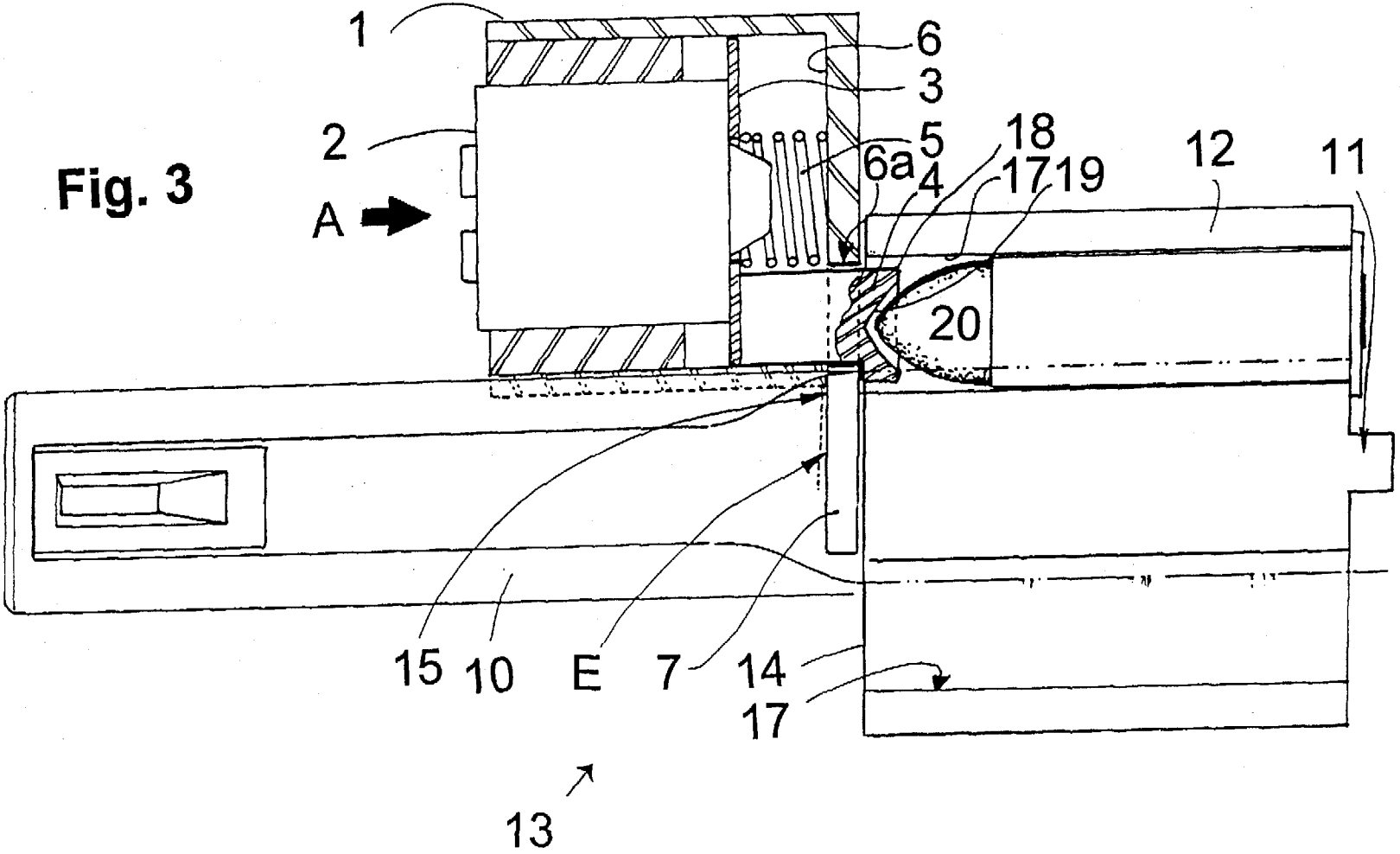
FIG. 3 shows a top view of the aforesaid device, which is in schematical cut and duly coupled to one of the chambers of the drum of a revolver.
Figure 5:
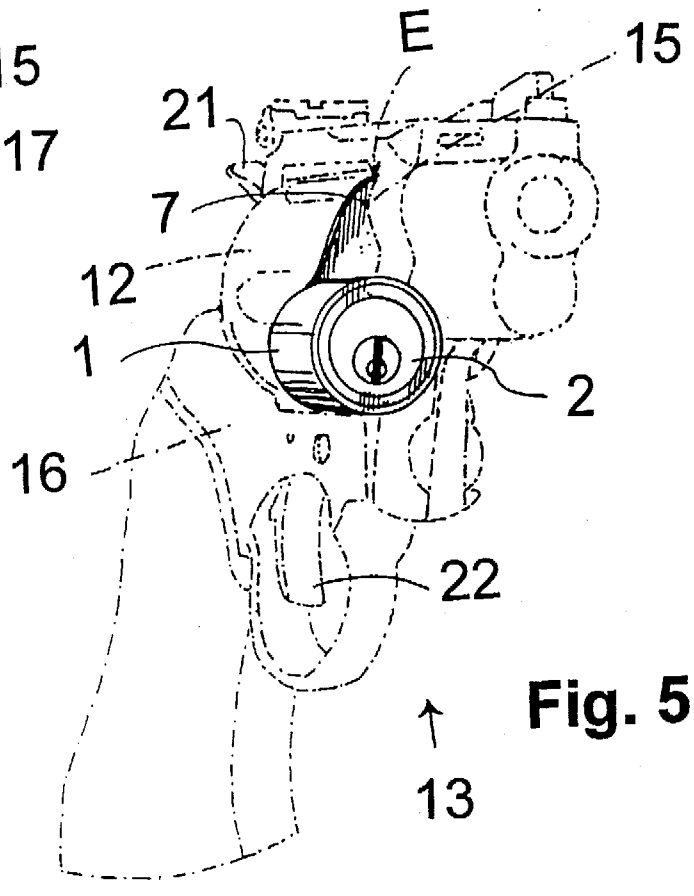
FIG. 5 shows a view which presents the revolver as in FIG. 4, but duly locked by the device.
Figure 4:
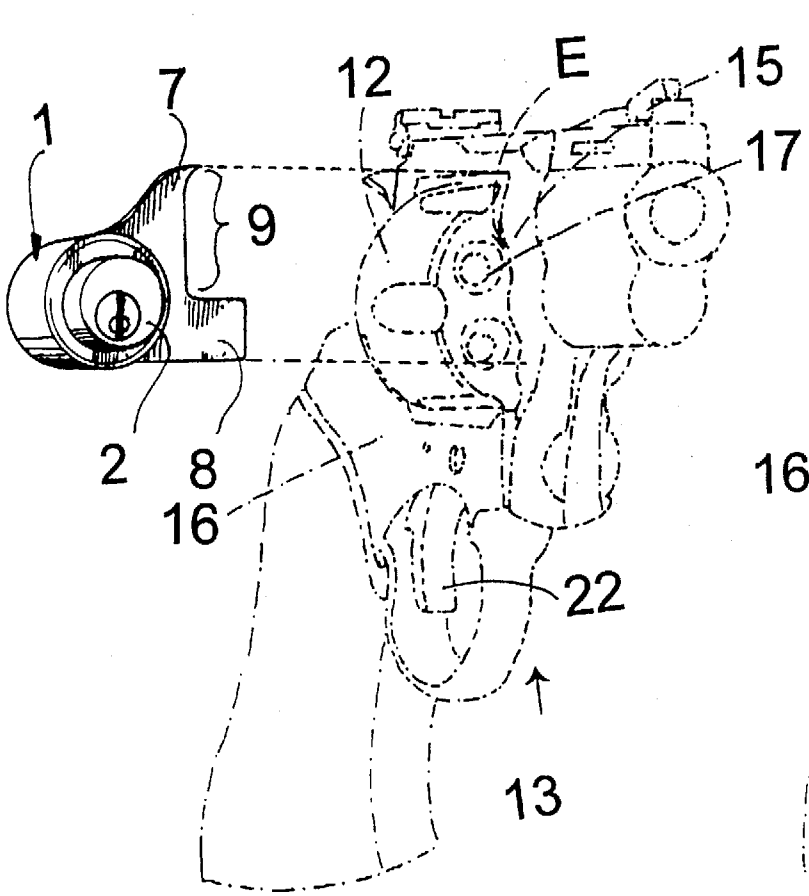
FIG. 4 shows a perspective view of a revolver with the aforesaid device separated from the revolver.

The bottom wall 6 consists of a window **6*a* through which passes the end of the locking element 4, in addition to the claw-shaped jutting flap 7 and to a square-profiled second flap 8, and between both flaps 7 and 8 a space generically shown by the numeric reference 9 is defined, a place which will be in contact with the rear end of the barrel 10 and with the rotation axle 11 of the drum 12 of the fire-arm 13, as shown by FIG. 3**.

The aforesaid device, as shown in the figures of this patent, is made in such a way that its flaps 7 and 8 are duly embedded in the space E which exists between the front face 14 of the drum 12 and the front part 15 of the body 16 of the fire-arm 13, and when duly positioned, this devise can have its key-core 2 compressed such as shown in FIG. 3 by the arrow A, fact which promotes the displacement of the locking element 4, which being aligned with one of the chambers 17, is introduced into it.

The end 18 of the locking element 4 shows a depression 19, aimed at making easier the arrangement of the pin 4 inside the chamber 17, close to bullet 20, when the aforesaid chamber is loaded as shown in FIG. 3.

Thus, when the actuation of the key-core 2 is over, such an actuation being carried out without the use of its respective key, this device is totally coupled to the fire-arm 13, in such a way, that prevents the rotation of the drum 12, in addition to also prevent the openness thereof, once the aforesaid device is couple to the drum 12 by the opposite side through which the drum is opened.

The drum 12 being privented to rotate, consequently the locking of the firing mechanism of the fire-arm is achieved by means of the simultaneous locking of the hammer 21 and the trigger 22 of the fire-arm 12, bearing in mind that they are mechanically linked to the aforesaid drum 12.

In order to renove this device, the user will use the key and actuate the core 2, in such a way that the core, through the action of the spring 5, is moved in the opposite direction, determining the retraction of the locking element 4, which is then withdrawn from the chamber 17 of the drum 12, enabling that the fire-arm 13 be effectively used.

Because of its embodiment, this devise must be used anywhere, once the space measure E, in most revolvers is around 3 mm.

In the same way, the embodiment of the rear end of the barrel 10, as well as its rotation axle 11 requires very few ajustments in the specific configuration of the flaps 7 and 8; moreover, these adjustments are quite easy.

As it is now quite obvious, the fire-arm 13, once locked by this device can be kept totally loaded, without any risks of being fired once the functioning principle of the fire-arm 13 has been locked in its essential point.

It must be pointed out that, despite having been broadly illustrated and described, this safety device can arise other models aesthetically different or especially dimensioned for some specific model of revolver.

Thus, the drawings which are part of this patent of invention must be analyzed as demonstratives of a new embodiment which is not limited to the model used as an example and in the same way and as already shown, new models of key-cores can be used as components of the aforesaid device.

I claim:

1. A firearm locking safety device comprising:

a main body having a tubular configuration and a bottom wall;

an axially displaceable keycore disposed within said main body, said keycore adapted to operate a piece, a locking element projecting from said piece; and a spring that biases said piece and bears against said bottom wall of said main body, said bottom wall comprising a window through which an end of said locking element can project, a claw-shaped flap, a square-profiled flap, and a space between said flaps.

2. The firearm locking safety device according to claim 1, wherein said space between said claw-shaped flap and said square-profiled flap contacts a rear end of a barrel of the firearm and a rotation axle of a drum of the firearm.

3. The firearm locking safety device according to claim 1, wherein said claw-shaped flap and said square-profiled flap are received in a space between a front face of a drum and a front part of the body of the firearm, said front face of the drum and said front part of the body being portions facing towards a muzzle of the firearm.

4. The firearm locking safety device according to claim 1, wherein axial displacement of said keycore actuates said locking element to project through said window.

5. The firearm locking safety device according to claim 1, wherein cooperation of a key with said keycore causes said keycore to axially move and actuates said locking element.

6. The firearm locking safety device according to claim 1, wherein actuation of said locking element causes said locking element to extend into a chamber of a drum of the firearm.

7. The firearm locking safety device according to claim 1, wherein an end of said locking element, opposite said piece, includes a depression.

8. The firearm locking safety device according to claim 7, said depression of said locking element enabling said locking element to extend into a chamber adjacent to a cartridge when the chamber contains a cartridge.

9. The firearm locking safety device according to claim 1, wherein projection of said locking element into a cartridge chamber of the firearm prevents rotation and opening of a drum of the firearm and precludes actuation of a hammer and trigger of the firearm.

10. The firearm locking safety device according to claim 1, wherein said safety device is attached to the firearm on a side opposite to a side at which a drum opens with respect to a body of the firearm.

11. The firearm locking safety device according to claim 7, said depression of said locking element enabling said locking element to extend into a chamber adjacent to a cartridge when the chamber contains a cartridge.

12. A firearm locking safety device comprising:

a cylindrical body having a bottom wall with a flange on one longitudianal end, said flange having a claw-shaped flap and a square-profiled flap, with a space defined between said flaps;

an actuating member having a locking element which may be projected through an aperture provided in said bottom wall;

a keycore axially movably disposed within said cylindrical body;

a spring which axially biases said actuating member and bears against said bottom wall; and wherein axial movement of said keycore by a key causes said actuating member to project said locking element through said aperture.

13. The firearm locking safety device according to claim 12, wherein said space between said claw-shaped flap and said square-shaped flap contacts an end of a barrel of the firearm and a rotation axle of a cylinder of the firearm.

14. The firearm locking safety device according to claim 12, wherein said claw-shaped flap and a square-profiled flap are received in a space in front of a cylinder drum of the firearm.

15. The firearm locking safety device according to claim 12, wherein axial movement of said actuating member projects said locking element into a cartridge chamber of a cylinder of the firearm and prevents rotation and opening of the cylinder and actuation of a hammer and a trigger of the firearm.

16. The firearm locking safety device according to claim 12, wherein said firearm locking safety device is removably attached to the firearm at a side opposite to a side which a cylinder opens with respect to a body of the firearm.

17. The firearm locking safety device according to claim 15, wherein an end of said locking element is concave, enabling said locking element to extend into said cartridge chamber when said cartridge chamber contains a cartridge.

* * * * *